US009932833B2

(12) United States Patent
Spadacini et al.

(10) Patent No.: US 9,932,833 B2
(45) Date of Patent: Apr. 3, 2018

(54) METHOD FOR BUILDING STAGES OF CENTRIFUGAL RADIAL TURBINES

(71) Applicant: EXERGY S.P.A., Bologna (IT)

(72) Inventors: Claudio Spadacini, Verbania Suna (IT); Marco Rizzi, Bisuschio (IT)

(73) Assignee: EXERGY S.P.A., Bologna (IT)

( * ) Notice: Subject to any disclaimer, the term of this patent is extended or adjusted under 35 U.S.C. 154(b) by 374 days.

(21) Appl. No.: 14/437,573

(22) PCT Filed: Oct. 10, 2013

(86) PCT No.: PCT/IB2013/059256

§ 371 (c)(1),
(2) Date: Apr. 22, 2015

(87) PCT Pub. No.: WO2014/064567

PCT Pub. Date: May 1, 2014

(65) Prior Publication Data

US 2015/0292332 A1 Oct. 15, 2015

(30) Foreign Application Priority Data

Oct. 24, 2012 (IT) ..... MI2012A1806

(51) Int. Cl.
*F01D 5/04* (2006.01)
*F01D 5/30* (2006.01)

(52) U.S. Cl.
CPC ..... *F01D 5/041* (2013.01); *F01D 5/3061* (2013.01); *F01D 5/3069* (2013.01); *F05D 2230/234* (2013.01); *F05D 2230/642* (2013.01)

(58) Field of Classification Search
CPC ..... F01D 5/041; F01D 5/3061; F01D 5/3069; F05D 2230/234; F05D 2230/642; B23K 2201/001
See application file for complete search history.

(56) References Cited

U.S. PATENT DOCUMENTS 1,740,800 A * 12/1929 Wiberg ..... B23P 15/006 29/889.21
2007/0017906 A1* 1/2007 Nowak ..... B23K 26/06 219/121.64

(Continued)

FOREIGN PATENT DOCUMENTS

DE 491 977 C 2/1930
FR 889 749 A 1/1944

(Continued)

*Primary Examiner* — Igor Kershteyn
*Assistant Examiner* — Eric Zamora Alvarez
(74) *Attorney, Agent, or Firm* — Pearne & Gordon LLP

(57) ABSTRACT

A method for building centrifugal radial stages of turbines, in which the first and the second end of each blade (4) are connected to respective two support rings (2, 3) joining, by means of laser welding, at least a first semi-portion (10) belonging to the respective end of the blade (4) to a respective second semi-portion (10) belonging to the respective support ring (2, 3) so as to form a resilient yielding connecting portion (10, 15) along a radial direction, and providing at least a stop portion (11) belonging to the end of the blade (4) facing, along the radial direction, at least a stop element (14) of the respective support ring (2, 3). The resilient yielding connecting portion (10, 15) enables the stop portion (11) to enter into contact with the stop element (14) when the stage (1) is subjected to the functioning loads of the turbine.

11 Claims, 3 Drawing Sheets

(56) References Cited

U.S. PATENT DOCUMENTS

| | | | | |
|---|---|---|---|---|
| 2010/0143103 | A1* | 6/2010 | Sellars | F16J 15/445<br>415/173.4 |
| 2013/0313307 | A1* | 11/2013 | Lacy | F01D 5/187<br>228/165 |

FOREIGN PATENT DOCUMENTS

| | | | |
|---|---|---|---|
| FR | 891 334 | A | 3/1944 |
| NL | 7 112 966 | A | 3/1973 |
| NL | 7112966 | A | 3/1973 |

* cited by examiner

METHOD FOR BUILDING STAGES OF CENTRIFUGAL RADIAL TURBINES

FIELD OF THE INVENTION

The present invention relates to a method for constructing stages of centrifugal radial stages. In particular, the present invention relates to the realizing of stages of multi-stage centrifugal radial turbines of the Ljungstrom type.

BACKGROUND OF THE INVENTION

As is known, each stage of the turbines comprises two coaxial and parallel support rings between which a plurality of blades are interposed, with the front edge and the rear edge extending substantially parallel to the rotation axis of the stage. The turbine comprises a plurality of concentric stages and the rings formed by the blades of each stage are arranged in series at a radial distance that is progressively greater in a distancing direction from the rotation axis. The flow of treated gas in the turbine enters axially at the axis or centre of the turbine and distances radially from the axis, crossing the stages arranged in succession one after another. The blades making up the first stage are the closest to the rotation axis of the turbine, while the blades of the final stage are the furthest away.

Document FR 889 749 illustrates a method for generating dangerous tensions during the fixing by welding of fins of gas or steam turbines. The method includes inserting, in the space delimited between the feet of the fin, a body able to deform freely under the effect of the welding tensions.

Document NL 7112966 illustrates a method for producing a rotor in which the blades extend radially from a sleeve-shaped hub, in which the blades and the hub are separately cast and then connected to one another.

SUMMARY

The Applicant has observed that the blades are subject to centrifugal forces which are created during normal functioning. Since on increasing the radius the centrifugal force increases linearly, the stress level present is at its highest especially on the final stages of the turbine. The blades, which develop between a ring and another along a substantially parallel direction to the rotation axis of the stage, tend to flex radially towards the outside, generating important stresses at the roots thereof, at the joints of the support rings.

Further, the Applicant has observed that the blades are subjected to heat gradients that occur during transitory steps. During the transitory step, the stresses due to the heat gradients are due to the fact that the part of the ring close to the blades heats before the remaining part of the machine, as it is directly struck by the hot fluid. Successively, at working speed, there is a different temperature between one stage and another, so that a ring which is astride the stage is subjected in turn to heat stresses due to this difference of temperature.

The Applicant has therefore set itself the objective of attenuating both the stress effects mentioned in the foregoing in the connecting zones between the blades and the support rings.

The Applicant has also set itself the objective of enabling an easy production in series of the stages.

The Applicant has found that these objectives can be attained by using a special geometry in the connecting zone that guarantees a limited and controlled elastic movement of the blade with respect to the support rings during the functioning of the turbine.

In particular, the present invention relates to a method for building stages of centrifugal radial turbines, comprising:

preparing a first support ring and a second support ring;

preparing a plurality of blades;

connecting a first end of each blade to the first support ring and a second end of each blade to the second support ring in such a way that the blade develops prevalently parallel to a rotation axis of the stage;

wherein connecting the first or second end to the respective first or second support ring comprises:

welding at least a first half-portion, resiliently yieldable along a radial direction and belonging to the respective end of the blade, to a second half-portion, resiliently yieldable along said radial direction and belonging to the respective support ring, to make a connecting portion resiliently yieldable along said radial direction;

placing at least a stop portion of said end of the blade facing, along said radial direction, at least a stop element of the respective support ring;

wherein the resiliently yieldable connecting portion allows the stop portion to come into contact with the stop element when the stage is subjected to the working loads of the turbine.

The present invention further relates to a stage of a centrifugal radial turbine comprising:

a first support ring and a second support ring;

a plurality of blades each presenting a first end and a second end; the blades developing prevalently parallel to a rotation axis of the stage;

first joints, each interposed between the first end of each blade and the first support ring, and second joints, each interposed between the second end of each blade and the second support ring;

characterized in that each of the first joints and/or the second joints comprises:

at least a connecting portion resiliently yieldable along a radial direction and linked to the respective blade and to the respective support ring;

at least a stop element integral with the respective support ring;

at least a stop portion integral with the respective blade and facing, along said radial direction, the stop element;

wherein the resiliently yieldable connecting portion allows the stop portion to come into contact with the stop element when the stage is subjected to the working loads of the turbine.

The present invention is also relative to a centrifugal radial turbine comprising at least a stage as described and/or claimed.

The function of the resilient yielding connection portion is not to constrain the structure too rigidly, thus enable small displacements between each blade and the two support rings, up to the contact between a surface belonging to the stop portion of the root of the blade. In particular, the resilient yielding connecting portion enables a centrifugal displacement of the blade, limited by the stop element, when the rotation of the turbine generates on the blade a centrifugal force which tends to displace/deform it radially in an external direction. The small radial displacements are, in general terms, comprised between about 0.1 mm and about 0.4 mm. The contact substantially prevents further relative displacements.

The elasticity due to the presence of the semi-portions (or lips) advantageously enables sharing the stresses between the ring and the root of the blade. The contact between the surfaces (apart from the tolerances) means that there is not a high flexing momentum at the base of the conjoining wall.

Further, as the blades are welded singly on the rings, the blades can be worked singly before assembling them, realising even very complex geometries with simple machinery.

The fact that the blades are individually welded on the ring further guarantees than in a case in which a weld is defective (formation of pores or splits which can invoke a breakage during the normal functioning), the spreading of the defect will not lead to the breakage of the whole stage, but influences only the single semiportion of the single blade. If on the other hand the weld were one only, the defect once initiated would spread along the whole welded surface, causing the total breakage of the stage and the turbine.

In a preferred embodiment, to connect the first or the second end to the respective first or second support ring, the method comprises: placing two first half-portions astride the stop element and welding them to respective second half-portions placed on sides of said stop element and radially spaced from said stop element. The method further comprises arranging two stop portions of said end facing, along said radial direction, opposite sides of the stop element.

In a section plane containing the rotation axis of the stage, the joint exhibits two of the resilient yielding portions located at opposite sides of the stop element and distanced from the stop element. Each resilient yielding portion is formed by a first semi-portion jointed to the blade and a second semi-portion jointed to the support ring. The first semi-portion and the second semi-portion are reciprocally welded.

In other words, each blade comprises a foot located at each of the two ends thereof. The foot exhibits a recess delimited by the two first semi-portions (or lips) in which the stop element is housed solidly to one of the support rings.

The realising of the resilient yielding portions (elastic lips) is done thanks to the possibility of assembling the components successively: a single-piece component would not be possible. Each first semi-portion preferably exhibits a thickness (measured along a radial direction) much smaller than the width thereof (measured along a circumferential direction). The thickness is preferably about ⅛ of the width.

Each resilient yielding portion preferably exhibits a radial thickness comprised between about ¼ and about ⅕ of a radial thickness of the stop element, the thickness depending on the number of blades on the ring and the solidity thereof.

During this positioning, each of the second semi-portions solidly constrained to the stop element and located on the two sides thereof are headed to the first semiportions and welded.

This type of assembly enables deciding in which zone to position the weld and, possibly, enables carrying out further work operations (piercing or milling) so as to avoid the fatigue notch effect between one blade and another on the welded surface.

In the section plane containing the rotation axis of the stage, the joint of each blade to the support ring exhibits a radially external resilient yielding portion (more distanced from the rotation axis of the stage) and a radially internal resilient yielding portion (closer to the rotation axis of the stage) with a preferably symmetrical profile.

Further, two stop portions, each solidly constrained to a respective semiportion of the blade, face the stop element.

The stop element thus limits both the centripetal motion and the centrifugal motion of the blade with respect to the ring.

The welding is preferably done by laser, preferably pulsed, preferably with complete or deep penetration (with the key-hole system).

The laser welding is a repeatable process, controllable and precise.

The heat-affected zone ZTA due to this working process is relatively small and poorly-developed. The hardness in the ZTA and the ZF (weld area) is substantially alike to the hardness of the base material.

Further, the residual tensions due to the working process are recuperable with heat treatments.

The welding is performed by displacing the welder along the width of the first and second reciprocally headed semi-portions.

A continuous laser emission process is not used as it is not suitable for welding such short tracts: it requires relatively fast speeds and this is usually associated with a delay in obtaining full penetration, with the risk of having missing initial penetration at the rear side but excessive fusion on the front side. So a laser machine was chosen that is able to function in pulsed operation too, characterised by lower working velocity but also by greater repeatability and controllability.

The pulse frequency is preferably comprised between about 40 Hz and about 60 Hz, and the pulse time is preferably comprised between about 8 ms and about 12 ms, equal to the waiting time. In the 8-12 ms waiting time the work point moves by about 0.1 mm with a significant percentage of area covered between successive pulses.

Two weld beads are preferably made along the width of the first and second semiportions, and at the centre of the width of the semiportions, between the two weld beads, a singular point or closing crater is situated. The singular points are due to the fact that key-hole welding tends to accumulate material at the start of the process and leave spaces in the closing point. The Applicant has found that in FEM analyses the least stressed part is at the centre of the width of the semiportions (weld toe). Therefore any singular points or weak points are advantageously positioned in proximity of the centre.

The Applicant notes that neither of the two turbines illustrated in the prior art documents FR 889 749 and NL7112966 is centrifugal radial but both are axial. In fact, the blades of these turbines develop radially about the hub, so that the flow of gas/steam crossing them is necessarily axial (therefore the turbine in axial).

It follows that the centrifugal force generated during the functioning of the turbines tends to distance the blades from the support and pull them radially but not flex them, as is instead the case with the centrifugal radial turbine of the present invention. It follows from this that the technical problems faced and obviated in these documents are different from those faced and obviated by the present invention and precedingly evidenced.

Further characteristics and advantages will more fully emerge from the detailed description that follows of a preferred but not exclusive embodiment of a stage of a centrifugal radial turbine according to the present invention.

DESCRIPTION OF THE DRAWINGS

The detailed description will be made in the following with reference to the accompanying drawings, provided by way of non-limiting example, wherein.

DETAILED DESCRIPTION

Figure 1:
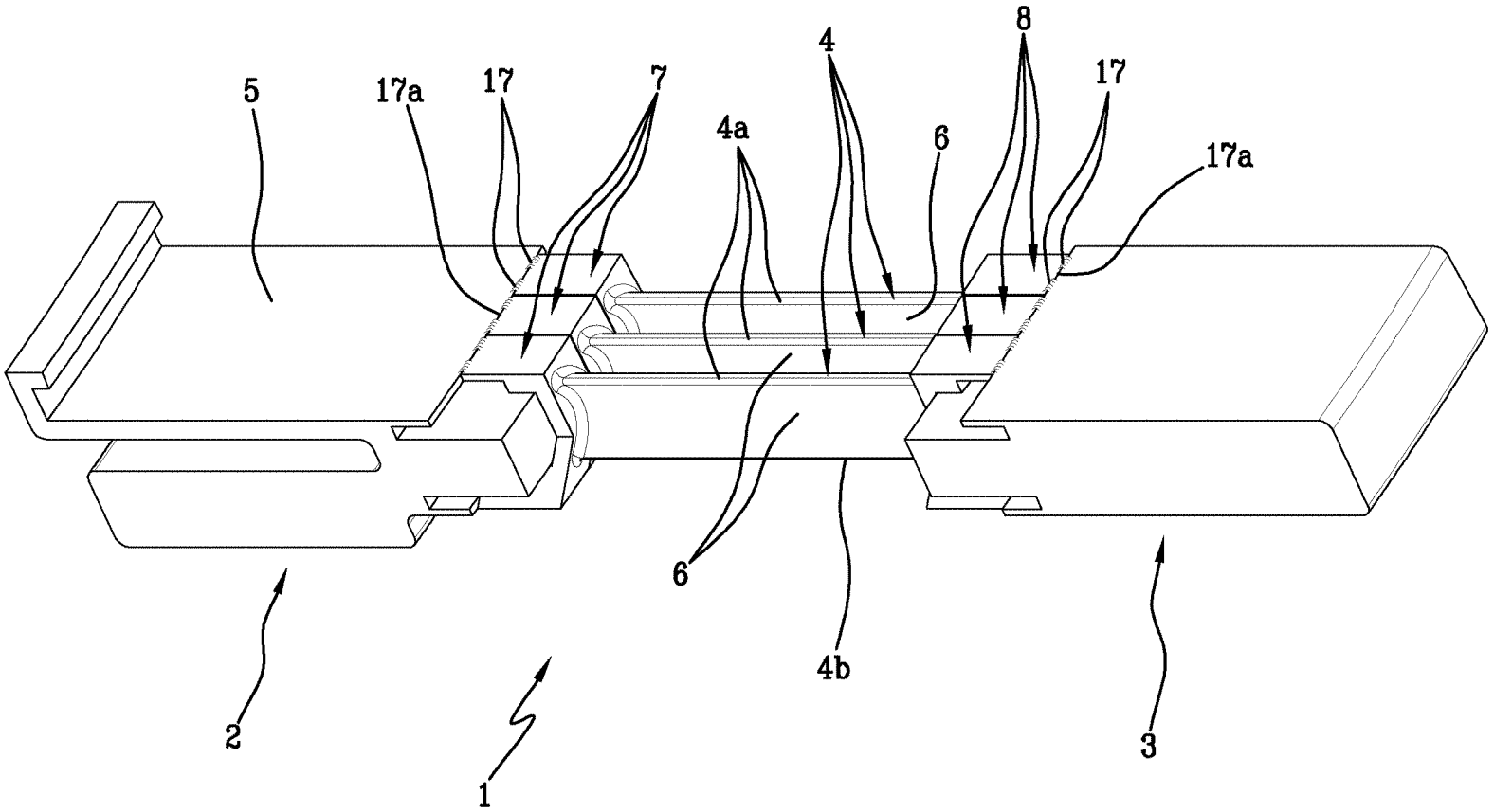
FIG. 1 is a perspective view of an angular sector of a stage of a centrifugal radial turbine according to the present invention.

With reference to the figures, 1 denotes in its entirety a stage of a centrifugal radial turbine of the Ljungstrom type (though only an angular sector is illustrated which subtends by an angle of a few degrees). In the stage 1 of the invention, the structure of the angular sector illustrated in FIG. 1 is extended by 360° to form a complete ring (not illustrated). The stage 1 comprises a first support ring 2, a second support ring 3 and a plurality of blades 4 which extend between the two support rings 2, 3 and connect the two support rings 2, 3. In the appended figures, only respective angular sectors of the two rings 2, 3 and the three blades 4 interposed between the angular portions are illustrated. The complete stage 1 comprises various tens of blades 4.

Figure 3:
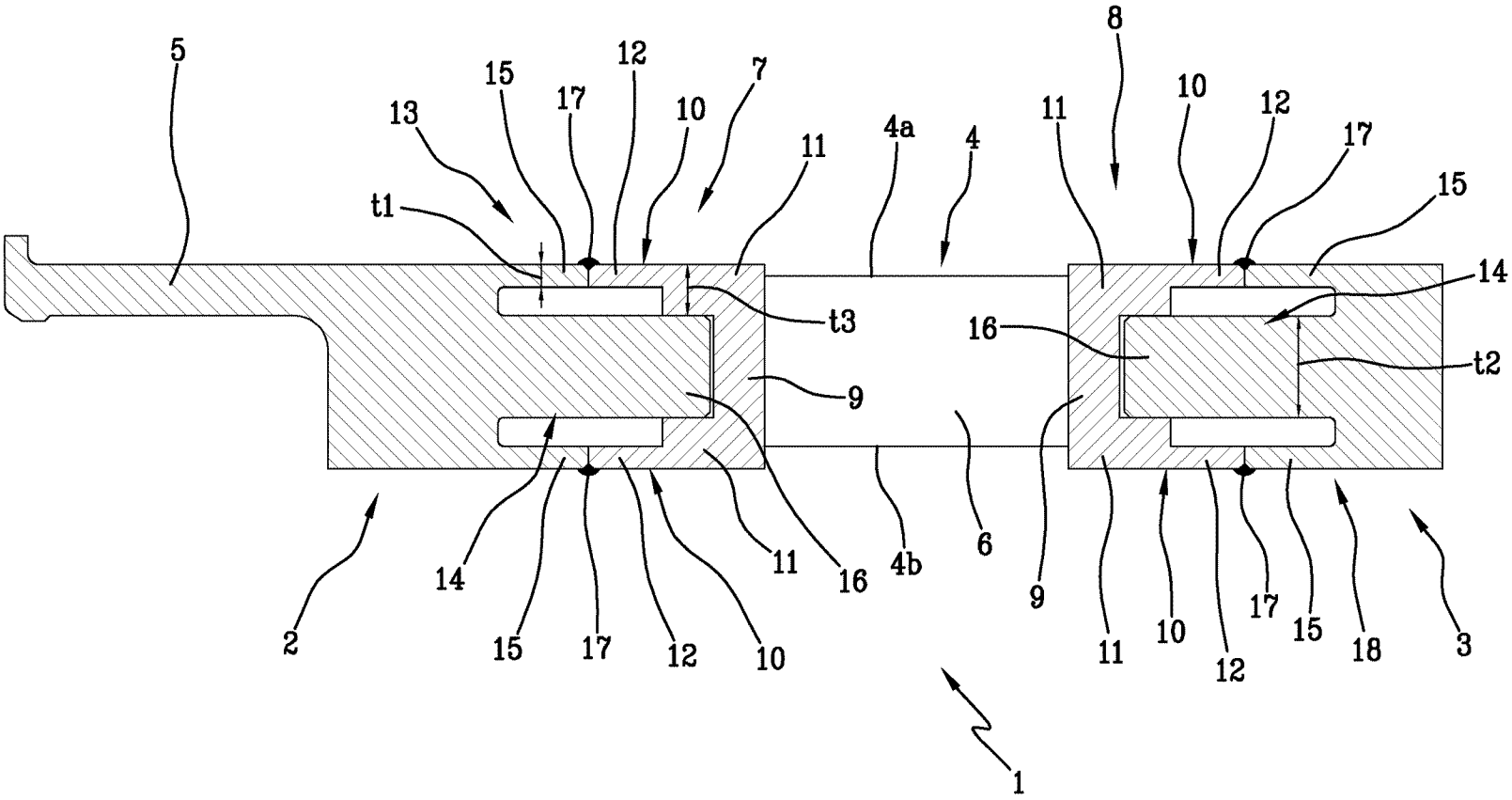
FIG. 3 is a section on an axial plane of a variant of the angular sector of FIG. 1.

The first ring 2 is connected to the rest of the turbine by means of a slim wall 5 which leaves the rings free to translate radially and elastically by a certain quantity when subjected to work loads of the turbine. In this way the stress level is considerably lowered in the hot zone of the machine (rings and blades). This translation prevents fluid-dynamic problems on the blades: the bladed part remains aligned, problems such as vortices at the base of the blade, variations in incidence, are avoided; these are problems which might have a determinant influence on the machines' performance. FIGS. 1 and 3 show different geometrical structures of the slim wall 5.

The blades 4 are connected to the first ring 2 at an opposite edge to the edge connected to the turbine. Each blade 4 comprises a central portion 6 provided with an aerodynamic profile, a first semi-joint 7 arranged on a first end of the blade 4 and a second semi-joint 8 arranged on a second end of the blade 4.

Each of the semi-joints 7, 8 seen in a section performed on an axial plane (a plane containing the rotation axis of the stage, FIG. 3), exhibits a substantially U-shaped profile, with a central element 9 and two first resilient yielding semiportions 10 which develop from the central element 9 parallel and reciprocally distanced. The first resilient yielding semiportions 10 are further substantially parallel to the development of the forward edge 4*a* and the rear edge 4*b* of the respective blade 4. The seatings delimited by the U-shaped profile of each of the semi joints 7, 8 are facing on opposite sides. Seen in the section performed on the axial plane (FIG. 3), each first semiportion 10 exhibits a proximal zone 11 (close to the central element 9) with a thickness 5 that is greater and a distal zone 12 (further from the central element 9) with a smaller thickness. The two proximal zones 11 are facing one another and closed to one another with respect to the two distal zones 12 of each semi-joint 7, 8.

On the opposite side to the one connected to the turbine, the first ring support 2, seen in the second made along the axial plane of FIG. 3, exhibits a third semijoint 13 formed by a central body 14 and two second resilient yielding semiportions 15 which develop parallel to the central body 14, along opposite sides thereof and distanced from the central body 14. The second resilient yielding semiportions 15 exhibit an axial development (parallel to the rotation axis of the stage 1) that is smaller than the axial development of the central body 14.

The central body 14 of the first support ring 2 is housed between the first resilient yielding semiportions 10 of the first semijoint 7 with a distal end 16 thereof positioned between the two proximal zones 11. Each of the two second resilient yielding semiportions 15 is jointed at a head to a respective first semiportion 10.

Figure 2:
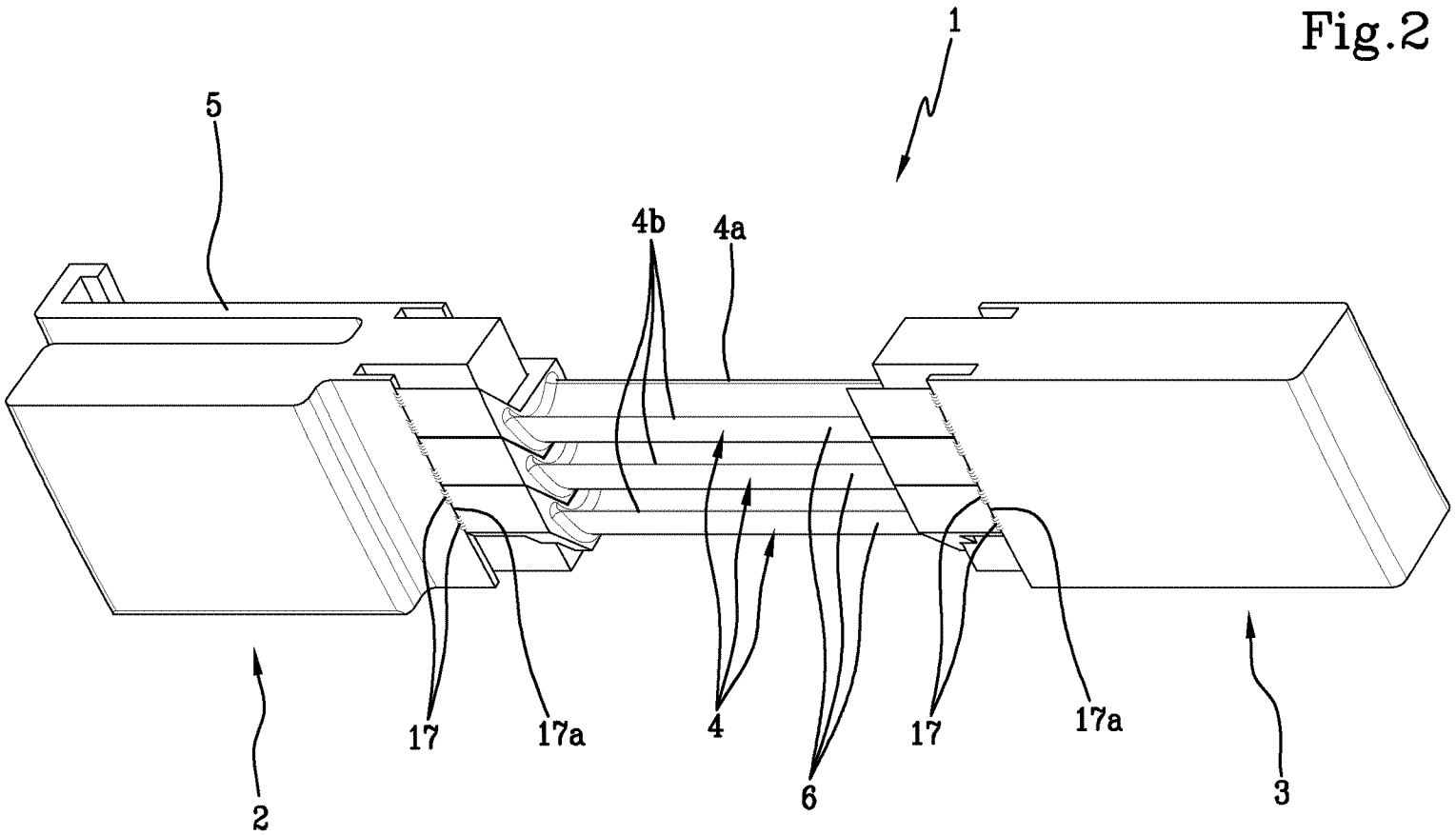
FIG. 2 is the angular sector of FIG. 1 in a different perspective view.

The joint is obtained by laser welding of the complete-penetration pulsed type. The frequency of pulsation is about 50 Hz with a weld time of about 10 ms. As can be seen in FIGS. 1 and 2, along the width (along the circumferential development of the stage) of each first resilient yielding semiportion 10, two weld beads 17 are made and a closing crater 17*a* is situated between the two weld beads 17.

In an embodiment that is not illustrated, in the zone of the closing crate 17*a* a through-opening is fashioned (hole, milling), through the resilient yielding first and second semiportions 10, 15, so as to avoid the notch effect, present between a blade and another on the welded surface.

The first semijoint 7 and the third semijoint 13 form a first joint 7, 13 interposed between the first end of the blade 4 and the first support ring 2. Each first semiportion 10 together with the second semiportion 15 to which it is welded form a single resilient yielding portion 10, 15.

The second semi-joint 8 of each blade 4 is connected to a fourth semi-joint 18 located on an edge of the second support ring 3. The second semijoint 8 and the fourth semijoint 18 form a second joint 8, 18 which, as visible in the figures, exhibits the same structural characteristics as the first joint 7, 13.

The resilient yielding portions 10, 15 of each joint enable, when the stage is subjected to the loads of the turbine when functioning, a relatively radial displacement between the blades 4 and the support rings 2, 3 which is limited by the contact between the proximal zone 11 of the respective first semiportion 10, which performs the function of a stop portion, with the distal end 16 of the respective central body 14, which functions as a stop element. The displacement is about 0.1 mm.

In the section made along the axial plane (FIG. 3), each resilient yielding portion 10, 15 exhibits a radial thickness "t1" of about ⅕ of the radial thickness "t2" of the stop element 14. Further, the proximal zone 11 exhibits a radial thickness "t3" of about double the radial thickness "t1" of the resilient yielding portion 10, 15.

The above-described stage 1 is constructed by realising the blades and the two support rings 2,3 separately and then positioning each blade 4 on the stages 2, 3 and welding it after positioning it.

The invention claimed is:

1. Method for building a stage of a centrifugal radial turbine, comprising:

preparing a first support ring (2) and a second support ring (3);

preparing a plurality of blades (4);

connecting a first end of each blade (4) to the first support ring (2) and a second end of each blade (4) to the second support ring (3) in such a way that the blade (4) develops prevalently parallel to a rotation axis of the stage;

wherein connecting the first or second end to the respective first or second support ring (2, 3) comprises:

welding at least a first half-portion (10), resiliently yieldable along a radial direction and belonging to the respective end of the blade (4), to a second half-portion (15), resiliently yieldable along said radial direction and belonging to the respective support ring (2,3), to make a connecting portion resiliently yieldable (10, 15) along said radial direction;

placing at least a stop portion (11) of said end of the blade (4) facing, along said radial direction, at least a stop element (14) of the respective support ring (2, 3);

wherein the resiliently yieldable connecting portion (10, 15) allows the stop portion (11) to come into contact with the stop element (14) when the stage (1) is subjected to working loads of the radial turbine.

2. Method according to claim 1, wherein connecting the first or the second end to the respective first or second support ring (2, 3) comprises: placing two first half-portions (10) astride the stop element (14) and welding the two first half portions (10) to respective second half-portions (15) placed on sides of said stop element (14) and radially spaced from said stop element (14).

3. Method according to claim 2, comprising: placing two stop portions (11) of said first or second end facing, along said radial direction, on opposite sides of the stop element (14).

4. Method according to claim 2, wherein the first half-portion (10) is welded endwise to the second half-portion (15).

5. Method according to claim 1, wherein the welding is laser welding.

6. Method according to claim 1, wherein the welding is a pulsed laser welding.

7. Stage of a centrifugal radial turbine, comprising:

a first support ring (2) and a second support ring (3);

a plurality of blades (4) each presenting a first end and a second end; the blades (4) developing prevalently parallel to a rotation axis of the stage;

first joints (7, 13), each interposed between the first end of each blade (4) and the first support ring (2), and second joints (8, 18), each interposed between the second end of each blade (4) and the second support ring (3);

characterized in that each of the first joints (7, 13) and/or the second joints (8, 18) comprises:

at least a connecting portion resiliently yieldable (10, 15) along a radial direction and linked to the respective blade (4) and to the respective support ring (2; 3);

at least a stop element (14) integral with the respective support ring (2; 3);

at least a stop portion (11) integral with the respective blade (4) and facing, along said radial direction, the stop element (14);

wherein the resiliently yieldable connecting portion (10, 15) allows the stop portion (11) to come into contact with the stop element (14) when the stage (1) is subjected to the working loads of the radial turbine.

8. Stage according to claim 7, wherein, in a section plane including the rotation axis of the stage (1), each of the first joints (7, 13) and/or of the second joints (8, 18) exhibits two of said resiliently yieldable connecting portions (10, 15) placed on opposite sides of the stop element (14) and spaced from said stop element (14).

9. Stage according to claim 7, wherein each resiliently yieldable connecting portions (10, 15) comprises a first half-portion (10) joined to the blade (4) and a second half-portion (10) joined to the support ring (2; 3) and wherein the first half-portion (10) and the second half-portion (15) are mutually welded.

10. Stage according to claim 7, wherein each resiliently yieldable connecting portions (10, 15) presents a radial thickness (t1) comprised between about ¼ and about ⅙ of a radial thickness (t2) of the stop element (14).

11. Method according to claim 1, wherein the welding is a full penetration laser welding.

* * * * *